US005641729A

United States Patent [19]

Leendersten

[11] Patent Number: 5,641,729

[45] Date of Patent: Jun. 24, 1997

[54] INTERNAL COMBUSTION ENGINE PREPARATION COMPOSITION

[75] Inventor: Howard V. Leendersten, Bellevue, Wash.

[73] Assignee: Hilton Oil Corporation, Bellevue, Wash.

[21] Appl. No.: 523,379

[22] Filed: Sep. 5, 1995

[51] Int. Cl.[6] ..... C10M 129/04; C10M 129/06; C10M 141/00

[52] U.S. Cl. ..... 508/111; 508/579; 508/588; 508/591

[58] Field of Search ..... 252/52 A; 123/1 A; 508/111, 579, 588, 591

[56] References Cited

U.S. PATENT DOCUMENTS

| | | | |
|---|---|---|---|
| 2,914,479 | 11/1959 | Tom et al. | 508/111 |
| 2,943,737 | 7/1960 | Norton | 508/111 |
| 3,028,334 | 4/1962 | Wilson | 252/18 |
| 3,426,738 | 2/1969 | Goodwine, Jr. | 508/579 |
| 3,838,049 | 9/1974 | Souillard et al. | 252/32.7 E |
| 3,953,179 | 4/1976 | Souillard et al. | 252/56 R |
| 4,496,632 | 1/1985 | Camp et al. | 252/52 A |
| 4,634,545 | 1/1987 | Zaleski et al. | 252/29 |
| 4,704,423 | 11/1987 | Iwanami et al. | 529/417 |
| 4,983,677 | 1/1991 | Johnson et al. | 525/127 |
| 5,049,291 | 9/1991 | Miyaji et al. | 252/50 |
| 5,064,594 | 11/1991 | Priester | 264/127 |
| 5,143,640 | 9/1992 | Moxey | 252/52 A |
| 5,266,225 | 11/1993 | Hall et al. | 252/52 A |
| 5,346,635 | 9/1994 | Behrooz | 252/33.3 |

OTHER PUBLICATIONS

Priester, et al., New Process Additives for Polyolefius Minimize Formulation Interactions; AWTEC pp. 2024–2027 (1992) Month Unknown.

Meier, JWL of Physical Chem; 71;6 pp. 1861–1866 (1967) Month Unknown.

Witco Corp., Product Specification 2013–7 Date Unknown.

Exxon Chemical Co., Product Description—Paratone 8259 Date Unknown.

Witco Corp., Product Description—Solvent Refined Naphtenil Base Oils Date Unknown.

Dow Corning, Product Analysis—200 FL 50 CS Date Unknown.

Exxon Chemical Co., Product Description—Paratac Date Unknown.

Exxon Chemical Co., Product Description—Paratone 715 Date Unknown.

*Primary Examiner*—Margaret Medley

*Attorney, Agent, or Firm*—McDonnell Boehnen Hulbert & Berghoff, Ltd.

[57] ABSTRACT

A composition and method for pretreating the internal metal surfaces an internal combustion engine to remove varnish and to neutralize zinc dialkyldithiophosphate in order to provide for maximum bonding of a fluoropolymer with the surfaces of the internal combustion engine, the composition including tripropylene glycol methyl ether.

3 Claims, No Drawings

INTERNAL COMBUSTION ENGINE PREPARATION COMPOSITION

BACKGROUND OF THE INVENTION (1) Field of the Invention

This invention is a composition of matter that may be used to prepare the internal metal surfaces of an internal combustion engine to accept a coating of fluoropolymer lubricant. The composition of this invention facilitates the bonding of a fluoropolymer to the internal surfaces of an internal combustion engine by neutralizing and removing zinc dialkyldithiophosphate from the metal surfaces of an internal combustion engine prior to flouoropolymer bonding. This invention is also a method for using the composition to pretreat the internal metal surfaces of an internal combustion engine to accept a fluoropolymer.

(2) Description of the Art

Internal combustion engines are relatively inefficient. One area where energy is lost is through friction between the engine pistons and cylinder walls. Furthermore, the friction causes undesirable piston and cylinder wear. Oil lubricants reduce the energy lost through piston/cylinder friction and they reduce piston and friction wear. It has been discovered that a coating of a fluoropolymer applied to the internal metal surfaces of an engine's cylinders and pistons further reduces piston/cylinder friction and wear thereby improving engine efficiency and longevity.

The lubricating properties of fluoropolymers are well known. Most consumers are familiar with fluoropolymers used as anti-stick agents in pots and pans. U.S. Pat. No. 4,983,677 and an article by D. E. Priester et al. *New Processing Additives For Polyolefins Minimize Formulation Interactions*, ANTEC 92 2024–27 (1992), describe methods for improving the efficiency of polymer extrusion, blow molding, and other polymer processes by coating the metal processing parts with a fluoropolymer. The fluoropolymer is added to a polymer composition from which the fluoropolymer deposits on the metal surfaces of the extruder or the mold.

Treating an internal combustion engine with a fluoropolymer has a similar effect. The fluoropolymer adheres to the surfaces of the cylinder and the piston. The adhered fluoropolymer acts as a lubricant and it reduces the friction caused by the movement of the piston in the engine cylinder. This, in turn, improves engine efficiency and it reduces engine wear.

The ability of a fluoropolymer to adhere to a metal surface is not absolute. Many chemicals and compounds actually inhibit the ability of a fluoropolymer to adhere to a metal surface. U.S. Pat. No. 5,064,594 describes talc and silica polymer melt additives as having a detrimental effect on the ability of the fluoropolymer to adhere to metal parts due to their abrasive nature. The article by D. E. Priester, cited above, discloses that polyolefin additives such as antiblock agents, pigments, and acid scavengers can have a detrimental effect on the ability of a fluoropolymer to coat to a metal surface. And U.S. Pat. No. 4,704,423 discloses that metal salts of higher fatty acids have the potential to reduce the effectiveness of a fluoropolymer as a lubricant processing aid.

Fatty acid derivatives and compounds such as calcium stearate or zinc stearate are materials that are sometimes used in motor oil additives as, for example, acid scavengers. Most premium motor oils include an additive, zinc dialkyldithiophosphate, that coats the piston and cylinder metal parts and that inhibits the ability of a fluoropolymers to bind to the metal piston and cylinder walls. As a result, the internal metal surfaces of an internal combustion engine that are coated with zinc dialkyldithiophosphate cannot easily accept a fluoropolymer.

SUMMARY OF THE INVENTION

An object of this invention is to provide a composition of matter that neutralizes and removes zinc dialkyldithiophosphate from internal metal surfaces of an internal combustion engine to be coated with a fluoropolymer.

Another object of this invention is to provide a composition of matter that is added to the crankcase of an internal combustion engine in order to prepare the metal inner surfaces of the engine for bonding with a fluoropolymer.

Still another object of this invention is to provide a method for preparing the metal surfaces of an internal combustion engine for bonding with a fluoropolymer.

In one embodiment, this invention is an composition comprising from 80 to 99 volume percent of at least one motor oil base stock and from 1 to 20 volume percent tripropylene glycol methyl ether.

In another embodiment, this invention is an engine preparation composition comprising about 89.4 volume percent of one or more motor oil base stocks, about 5.0 volume percent tripropylene glycol methyl ether, about 0.02 volume percent of a silicone antifoam agent, about 5.14 volume percent ECA—10069, and about 0.40 volume percent polyisobutylene.

In still another embodiment, this invention is a method for preparing an internal combustion engine for fluoropolymer coating. The method uses an internal combustion engine preparation comprising from 80 to 99 volume percent of at least one motor oil base stock and from 1 to 20 volume percent tripropylene glycol methyl ether. The method is accomplished by first warming the internal combustion engine to operating temperature. Next, an amount of internal combustion engine preparation sufficient to remove at least some zinc dialkyldithiophosphate from the metal surfaces of the internal combustion engine is added to a crankcase associated with the internal combustion engine. The internal combustion engine is operated for a period of time sufficient to remove at least some zinc dialkyldithiophosphate from the metal surfaces of the internal combustion engine and then the engine is stopped. Finally, the fluid in the crankcase of the internal combustion engine is drained to give a pretreated internal combustion engine.

DESCRIPTION OF THE CURRENT EMBODIMENT

The present invention relates to a composition of matter useful for preparing the internal metal surfaces of an internal combustion engine for bonding with a fluoropolymer. The present invention is also a method for using a composition of this invention to prepare the internal metal surfaces of an internal combustion engine for maximum fluoropolymer bonding.

The composition of this invention may be used to pretreat any metal surface for bonding with a fluoropolymer. It is possible to use the composition to pretreat plastic manufacturing equipment, for example, to enhance the ability of a fluoropolymer to bond to the equipment. It is most preferred that the composition of this invention is used to pretreat the internal metal surfaces of an internal combustion engine that are coated with zinc dialkyldithiophosphate. The composition of this invention neutralizes and removes zinc dialkyldithiophosphate from the engine metal surfaces that would otherwise inhibit fluoropolymer bonding to the metal surfaces.

The composition of this invention is unique because it does not contain kerosene or other light hydrocarbon solvents. That are typically included in engine preparation compositions to remove varnish build-up from the internal walls of the engine. It is well known that varnish can actually aid in maintaining the integrity of an older engine. Therefore, kerosene is omitted from the composition of this invention in order to ensure that varnish is not removed from the internal combustion engine.

The composition of this invention is also unique because it includes tripropylene glycol methyl ether. It has been discovered that tripropylene glycol methyl ether neutralizes and removes organic and inorganic salts containing divalent and/or trivalent metal cations, such as zinc dialkyldithiophosphate, zinc stearate, calcium stearate and others, from the metal surfaces of internal combustion engines. If not removed, the zinc ionomers inhibit the ability of a fluoropolymer to bond to the internal metal surfaces of an internal combustion engine.

The composition of this invention comprises tripropylene glycol methyl ether combined with at least a motor oil base stock to create an internal combustion engine pretreatment composition. The amount of tripropylene glycol methyl ether included in the engine pretreatment composition determines the rate of the neutralization and removal of zinc dialkyldithiophosphate from the internal metal surfaces of an engine. The tripropylene glycol methyl ether may be present in the composition in an amount ranging from 1 to 30 volume percent. It is preferred that the composition include from about 4 to about 6 volume percent tripropylene glycol methyl ether so that the composition can remove zinc dialkyldithiophosphate from the internal metal surfaces of the engine in from about 2 to about 10 minutes.

The composition of this invention also includes a motor oil base stock. Any motor oil base stock may be used in the composition of this invention. The motor oil base stock is acts as a carrier and diluent for the tripropylene glycol methyl ether as well as any other additives included in composition of this invention. It is preferred that the selected motor oil base stock have viscosity characteristics similar to the viscosity characteristics of the motor oil found in the internal combustion engine crankcase.

The motor oil base stock can be a natural oil or a synthetic lubricating oil. Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propyleneisobutylene, copolymers, chlorinated polybutylenes, etc.); poly(1-hexenes), poly(1-octenes), poly(1-decenes) and mixtures thereof; alkylbenzenes (e.g., dodecylbenzenes, tetradecylbenzenes dinonylbenzenes di-(2-ethylhexylbenzenes); polyphenyls (e.g., biphenyls, terphenyls, alkylated polyphenyls); alkylated diphenyl ethers and alkylated diphenyl sulfides and the derivatives, analogs and homologs thereof and the like.

Combinations of two or more motor oil base stocks having different properties such as viscosity, flash point temperature, or the like may be blended to create a motor oil base stock useful in the composition of this invention. It is preferred that the motor oil base stocks used in the engine pretreatment composition have an API Gravity of about 27.0 (ASTM D-1298) and a viscosity at 100° C. of about 1.9 to about 2.1 cSt (ASTM D-445).

The motor oil base stock will be present in the composition of this invention in an amount ranging from about 70 to about 99 volume percent. It is preferred that one or more motor oil base stocks are used in the composition of this invention in an amount ranging from about 70 to about 90 volume percent.

A preferred motor oil base stock is sold under the trademark WITCO 2013-7 and manufactured by WITCO, Corporation, Greenwich, Conn. WITCO 2013-7 is a motor oil base stock that has a 30 second neutral viscosity, an API gravity at 60°/60° F. of about 25.0 (ASTM D-1298) and a viscosity at 100° C. of about 3.5 cSt (ASTM D-445) and a flash point (COC) of 158° C. (ASTM D-92). It is preferred that the engine pretreatment composition include a blend of WITCO 2013-7 and a motor oil base stock sold under the trademark 2013-20 and manufactured by WITCO Corporation, Greenwich, Conn. in a ratio ranging from 25:1 to 10:1. WITCO 2013-20 is a solvent refined naphthenic base oil having an API gravity at 60°/60° F. of 25.0, a viscosity at 40° C. of 20.1 centistokes and a flash point (COC) of 158° C.

The composition of this invention may include additives that may impart desirable characteristics to the engine preparation composition. Useful additives may include viscosity index improvers, antifoam agents, pour point depressants, corrosion inhibitors, and binders.

A viscosity index improver may be added to the engine pretreatment composition. Viscosity index improvers reduce the tendency of an oil to change viscosity with temperature. Viscosity index improvers are generally high molecular weight polymers or copolymers. Some viscosity index improvers may function as pour point depressants and also as dispersants. The viscosity index improvers are generally selected from polyisobutylene, olefin copolymers, styrene ester and polymethacrylates. The viscosity index improver may be present in the engine preparation composition of this invention in an amount ranging from about 2 to about 10 volume percent.

A preferred viscosity index improver is an olefin copolymer (OCP) ECA-10069. ECA-10069 is a predissolved Paratone 715 manufactured by Exxon Chemical, Houston, Tex. The preferred ECA-10069 viscosity index improver may be present in the engine preparation composition of this invention in an amount ranging from about 4 to about 6 volume percent.

The engine preparation composition of this invention may optionally include a silicone antifoam additive. The antifoam additive may be present in the engine preparation composition in an amount ranging from about 0.001 to about 1.0 volume percent. A preferred composition of this invention includes a silicone antifoam agent designated 200 Silicon and manufactured by Dow Corning, Midland, Mich. The Dow Corning 200 Silicon is preferably present in the preferred engine preparation composition in an amount ranging from about 0.01 to about 0.10 volume percent.

The engine preparation composition of this invention may optionally include a tackiness agent. The tackiness agent acts as a binder to keep all of the components of the engine preparation composition emulsified. Any tackiness agent or emulsifier known in the art may be used for this purpose. A preferred tackiness agent is polyisobutlyene manufactured under the tradename PARATAC by The Exxon Chemical Company, Houston, Tex. The tackiness agent may be present in the composition in an amount ranging from about 0.1 to about 2.0 volume percent. The preferred tackiness agent is polyisobutylene.

The composition of this invention is most useful for pretreating internal combustion engines prior to contacting the metal surfaces of the internal combustion engine with a fluoropolymer containing oil. The engine pretreating composition of this invention is most useful when used to pretreat internal combustion engines that have been operated for long periods of time and that are fouled with zinc dialkyldithiophosphate.

The composition of this invention is used by adding it to the crankcase of an internal combustion engine while the engine is operating at its normal temperature. Therefore, the first step in pretreating an internal combustion engine with the composition of this invention is to warm the internal combustion engine to operating temperature.

When the internal combustion engine is warm, the composition of this invention is added to the crankcase of the operating internal combustion engine. The composition is preferably added to the crankcase though the oil addition port of the internal combustion engine. However, any means known for adding oil to the crankcase of an internal combustion engine may be used.

The composition of this invention mixes with the oil present in the crankcase of the internal combustion engine from which the mixture is circulated throughout the engine. The amount of pretreatment composition added to the crankcase of the internal combustion engine may vary from about 8 to about 364 fluid ounces. The amount will vary depending factors such as the number of hours the internal combustion engine has operated, the type of lubricating oil used in the engine crankcase, the amount and type of the residues present on the internal surfaces of the internal combustion engine, and the amount of tripropylene glycol methyl ether in the composition.

It is preferred that about a quart (32 ounces) of an engine pretreatment composition is added to the crankcase of the operating internal combustion engine. A quart will be sufficient to pretreat the internal metal surfaces of the engine for coating with a fluoropolymer by removing at least some zinc dialkyldithiophosphate from engine surfaces. Also, consumers are familiar with quart packaging for lubricating oils and, therefore, the preferred composition should be blended to provide optimum pretreatment in a short period of time using a quart of engine pretreatment composition.

The composition is allowed to contact the internal surfaces of the internal combustion engine for a period of time sufficient to neutralize and remove at least some zinc dialkyldithiophosphate from the internal metal surfaces of the engine being prepared for fluoropolymer coating. The internal combustion engine should be operated with the composition in the crankcase for longer than about one minute and less than about one hour. It is preferred that the internal combustion engine is operated for from about 3 minutes to about 20 minutes while the composition of this invention is in the engine crankcase.

After operating the internal combustion engine for a sufficient period of time with the composition of this invention in the crankcase, the engine is stopped and the crankcase is drained of fluid. The fluid withdrawn from the crankcase comprises a mixture of lubricating oil, the engine pretreatment composition of this invention, and any contaminants removed from the internal metal surfaces of the internal combustion engine. It is preferred that the engine oil filter is also removed from the engine and replaced with a new oil filter.

At this point the engine is pretreated and the internal metal surfaces are in a condition to bond efficiently with a fluoropolymer. A preferred fluoropolymer is manufactured by Du Pont de Nemours and designated by the Trademark TEFLON. However, any other fluoropolymers that are know to those of skill in the art to have metal bonding and lubricating properties may be used.

The fluoropolymer is preferably added to the pretreated internal combustion engine in the form of an oil additive. Any oil additive containing a fluoropolymer may be used. Examples of fluoropolymer oil additive include T-PLUS Engine Treatment with Du Pont TEFLON manufactured by Hilton Oil Corporation, Bellevue, Wash. The fluoropolymer oil additive should be added to the engine crankcase following the manufactures recommendations. For example, T-PLUS Engine Treatment is combined with motor oil in a 20:80 volume ratio until the engine crankcase contains the recommended amount of fluid.

The invention is illustrated further by the following example which is not to be construed as limiting the invention in scope or spirit to the specific compositions or procedures described.

EXAMPLE I

This Example describes the preparation and use of an engine pretreatment composition of this invention. An engine pretreatment composition was blended based upon the following recipe:

| Motor Oil Based Stock: | Preferred Range (Vol. %) | Actual Range (Vol. %) |
|---|---|---|
| Witco Code 2013-7 | 84–86 | 85.0 |
| Witco Code 2013-20 | 4–5 | 4.44 |
| Tripropylene Glycol Methyl Ether | 4–6 | 5.0 |
| Viscosity Index Improver | | |
| ECA - 10069 | 4–6 | 5.14 |
| Silicone Antifoam | | |
| Dow Corning 200 | 0.01–0.03 | 0.02 |
| Tackiness Agent | | |
| Paratac | 0.25–0.75 | 0.40 |

One quart of the composition is added to the crankcase of a warmed-up, operating internal combustion engine. The engine is allowed to operate from about 3 to about 10 minutes with the pretreatment composition in the crankcase. The oil/pretreatment composition is drained from the crankcase and the oil filter is replaced. The crankcase is filled with lubricating oil that compiles with the engine manufacturers' crankcase oil specification. A quart of fluoropolymer containing additive such as T-PLUS Engine Treatment manufactured by Hilton Oil Corporation, Bellevue, Wash. is added to the crankcase. An internal combustion engine thus treated will have improved longevity and operating efficiency, such as improved gas mileage, in comparison to engines treated with a fluoropolymer oil added alone.

The description above has been offered for illustrative purposes only, and it is not intended to limit the scope of the invention of this application which is defined by the following claims.

What I claim is:

1. A method for preparing an internal combustion engine fouled with zinc dialkyldithiophosphate for fluoropolymer coating using an internal combustion engine preparation comprising from 80 to 99 volume percent of at least one motor oil base stock and from 1 to 20 volume percent tripropylene glycol methyl ether by the steps comprising;

a. warming the internal combustion engine to operating temperature;

b. adding an amount of internal combustion engine preparation to a crankcase associated with the internal combustion engine sufficient to remove at least some zinc dialkyldithiophosphate from the metal surfaces of the internal combustion engine;

c. operating the internal combustion engine for a period of time sufficient to remove at least some zinc dialkyldithiophosphate from the metal surfaces of the internal combustion engine d. stopping the engine; and e. draining the crankcase of the internal combustion engine to give a pretreated internal combustion engine; and f. adding a motor oil comprising a fluoropolymer to the pretreated internal combustion engine.

2. The method of claim 1 wherein the internal combustion engine is operated with the internal combustion engine preparation in the crankcase for from about 3 minutes to about 20 minutes.

3. A method for treating an internal combustion engine using an internal combustion engine preparation comprising about 89.4 volume percent of one or more motor oil base stocks, about 5.0 volume percent tripropylene glycol methyl ether, about 0.02 volume percent of a silicone antifoam agent, about 5.14 volume percent of an olefin copolymer and about 0.40 volume percent polyisobutylene by the steps comprising;

a. warming the internal combustion engine to operating temperature;

b. adding about a quart of the internal combustion engine preparation to a crankcase associated with the internal combustion engine;

c. operating the internal combustion engine for from about 3 minutes to about 20 minutes;

d. stopping the internal combustion engine;

e. draining the crankcase of the internal combustion engine to give a pretreated internal combustion engine;

f. replacing a motor filter associated with the internal combustion engine; and g. adding a motor oil comprising a fluoropolymer to the pretreated internal combustion engine.

* * * * *